United States Patent [19]

Stutsman

[11] Patent Number: 4,494,675

[45] Date of Patent: Jan. 22, 1985

[54] ARTICLE DISPENSING MACHINE WITH ANTI-THEFT STRUCTURE

[75] Inventor: Richard R. Stutsman, Mt. Baldy, Calif.

[73] Assignee: Vertx Corporation, Salt Lake City, Utah

[21] Appl. No.: 384,144

[22] Filed: Jun. 1, 1982

[51] Int. Cl.[3] ..... G07F 11/42

[52] U.S. Cl. ..... 221/13; 221/129; 221/196

[58] Field of Search ..... 221/12, 13, 129, 130, 221/131, 150 HC, 150 A, 195, 196, 264

[56] References Cited

U.S. PATENT DOCUMENTS

| | | | |
|---|---|---|---|
| 2,474,142 | 6/1949 | Compton | 221/131 X |
| 2,599,906 | 6/1952 | Farmer | 221/130 X |
| 3,675,816 | 7/1972 | Bourke et al. | 221/12 X |
| 4,125,205 | 11/1978 | Ambroise | 221/129 |
| 4,215,800 | 8/1980 | Collins et al. | 221/129 |
| 4,252,250 | 2/1981 | Toth | 221/13 |

*Primary Examiner*—F. J. Bartuska

*Attorney, Agent, or Firm*—Pretty, Schroeder, Brueggemann & Clark

[57] ABSTRACT

A dispensing machine including a plurality of receptacles from which articles are released to fall into a receiving chamber. After movement along the chamber by a conveyor, the articles enter a delivery mechanism that moves them into alignment with an escape opening through which they fall into an exit tray. With the delivery mechanism in a closed position, the carrier is aligned to receive an article from the chamber and a guard covers the opening. In an open position, the carrier is aligned with the opening, but access to the chamber through the exit tray is prevented.

13 Claims, 8 Drawing Figures

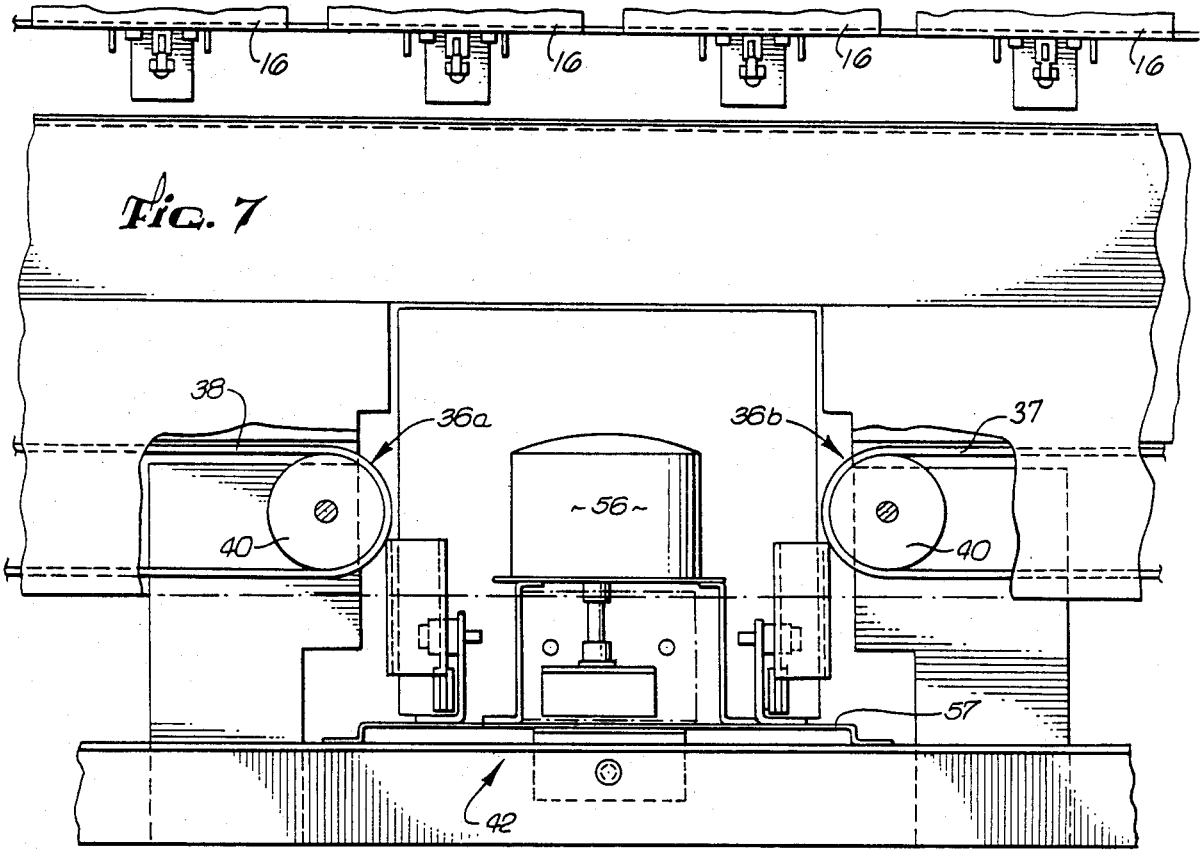
Fig. 7
Fig. 8
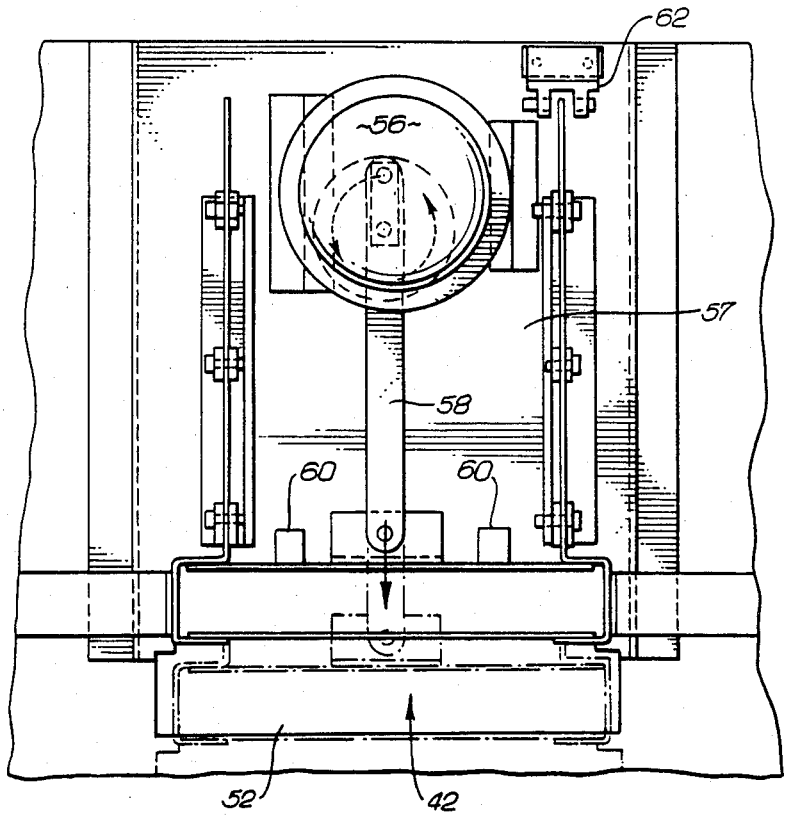

ARTICLE DISPENSING MACHINE WITH ANTI-THEFT STRUCTURE

FIELD OF THE INVENTION

The present invention relates to dispensing machines and more particularly to dispensing machines with an anti-theft structure that prevents unauthorized access to the interior thereof.

BACKGROUND OF THE INVENTION

A variety of dispensing machines are known that contain a plurality of receptacles in which articles are stored. When the machine is actuated, an article is released from one of the receptacles and falls into an exit tray where it is readily accessible. Many coin operated cigarette vending machines are of this type.

One problem of increasing seriousness associated with dispensing machines is theft. It is often possible to insert a tool or even a hand into the opening through which the articles are dispensed to cause the articles to be released. Although this problem is a matter of some concern in the case of machines that vend such items as cigarettes and candy, it is a far greater problem if the machine is used to dispense more expensive articles such as prerecorded audio and video tape cassettes or video game cartridges. In some types of retail businesses, such as the sale of prerecorded tape cassettes, inventory shrinkage is a major problem that threatens the economic viability of many establishments.

A relatively theft proof dispensing machine would have additional uses beyond those of the traditional coin operated vending function. For instance, it could be positioned within a retail establishment and loaded with the principal inventory of the business that would otherwise be stored on shelves. Used in this way, it would prevent pilferage by both customers and employees.

A fully satisfactory answer to the problem of blocking of the opening through which the dispensed article falls into the exit tray to prevent the release of articles in the machine has not been found heretofore. One possible approach is to cause the article to slide down a ramp or tube, following a circuitous route. However, this approach requires that a substantial portion of the space available above the exit tray be devoted to a ramp for which a minimum angle of incline must be maintained. The ability of the machine to store articles to be dispensed is reduced accordingly or else the exit tray must be inconveniently positioned too close to the floor.

Another approach to preventing access to the interior of the machine has been to provide a device that blocks the opening when the article is dispensed. However, such a device must be designed so that it will not injure a hand that is inserted in the opening. Moreover, such devices can usually be defeated by blocking the device in an open position while it is going through its normal operating cycle.

An objective of the present invention is to provide a dispensing machine that effectively uses the maximum space available for the storage of goods to be dispensed. A further objective is to provide such a vending machine having highly effective anti-theft characteristics.

SUMMARY OF THE INVENTION

The present invention resides in a dispensing machine that accomplishes the above objectives. It includes a plurality of receptacles for storing articles to be dispensed and an article releasing mechanism associated with each receptical. Beneath the receptacles is an article receiving chamber and beneath the chamber is an exit tray. A conveyor, preferably an endless belt, carries articles along the chamber to a delivery mechanism that causes the articles to fall through an opening into the exit tray.

Preferably, the delivery mechanism includes a carrier for the articles that is movable between a closed position for receiving articles from the conveyor and an open position aligned with the opening. A guard member may be connected to the carrier for reciprocatory movement therewith to block the opening.

The delivery mechanism can be centered, with the conveyor or divided into two sections, one on either side of the delivery mechanism. Sensors determine that an article has entered the carrier and that the carrier has returned to its home position.

While a particular form of the invention has been illustrated and described, it will be apparent that various modifications can be made without departing from the spirit and scope of the invention.

BRIEF DESCRIPTION OF THE DRAWINGS

FIG. 7 is an enlarged fragmentary front view of the delivery mechanism; and

FIG. 8 is an enlarged fragmentary top view of the delivery mechanism in its closed position, the open position being illustrated in phantom lines.

DESCRIPTION OF THE PREFERRED EMBODIMENT

Figure 1:
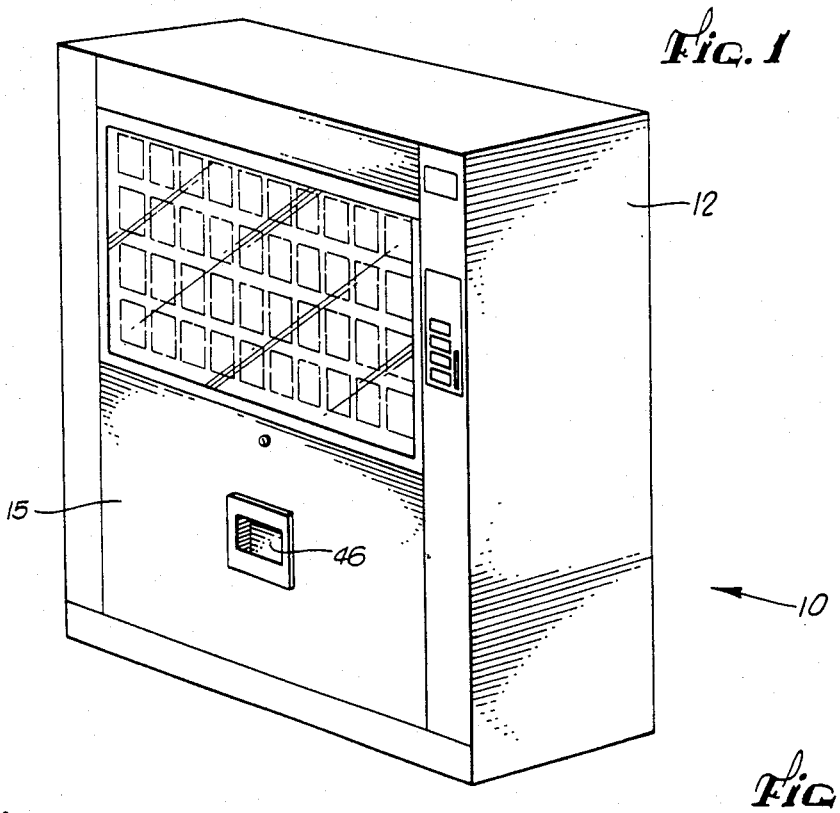
FIG. 1 is a perspective view of a dispensing machine constructed in accordance with the present invention.
Figure 2:
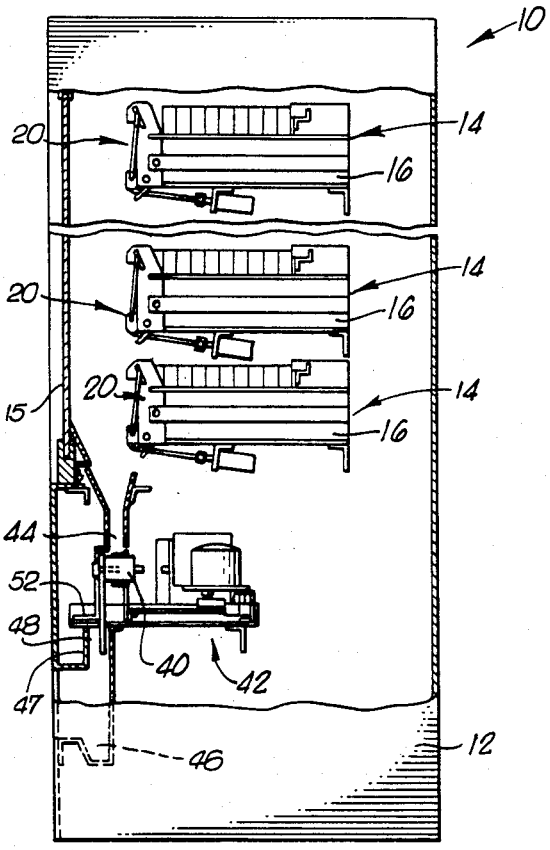
FIG. 2 is a partially broken away left side elevation of the machine of FIG. 1, showing the article receptacles and delivery mechanism.

Many unique and advantageous features of the present invention may be found in the exemplary machine 10 illustrated in FIGS. 1 and 2 of the accompanying drawings. Although this is a coin operated machine, it will be understood that the invention is equally applicable to other types of dispensing machines such as those that are remotely controlled electronically. There are many known arrangements for signalling the mechanical and electro-mechanical components to be actuated to dispense an article when certain conditions, such as the deposit of coins, have been met, and those arrangements will not be described here.

The machine 10 includes a box-like cabinet 12 in which four drawers 14 are stacked one above the other, as best shown in FIG. 2. Each drawer 14 can be pulled out, once a door-like front panel 15 of the cabinet 12 has been opened, to expose a row of ten open-topped, trough-like receptacles 16 in which articles 18 to be vended are arranged from front to back, one behind the other. With the drawer 14 in this withdrawn position, the receptacles 16 can be easily loaded from above.

At the front of each receptacle 16 is a releasing mechanism 20 including an open frame 21 with a trap door-like support member 22 that forms the bottom. This releasing mechanism 20 is best shown in FIGS. 2, 3, 4 and 5 and is described in greater detail in U.S. Pat. No. 4,215,800 issued to Rollins et al. on Aug. 5, 1980.

Figure 4:
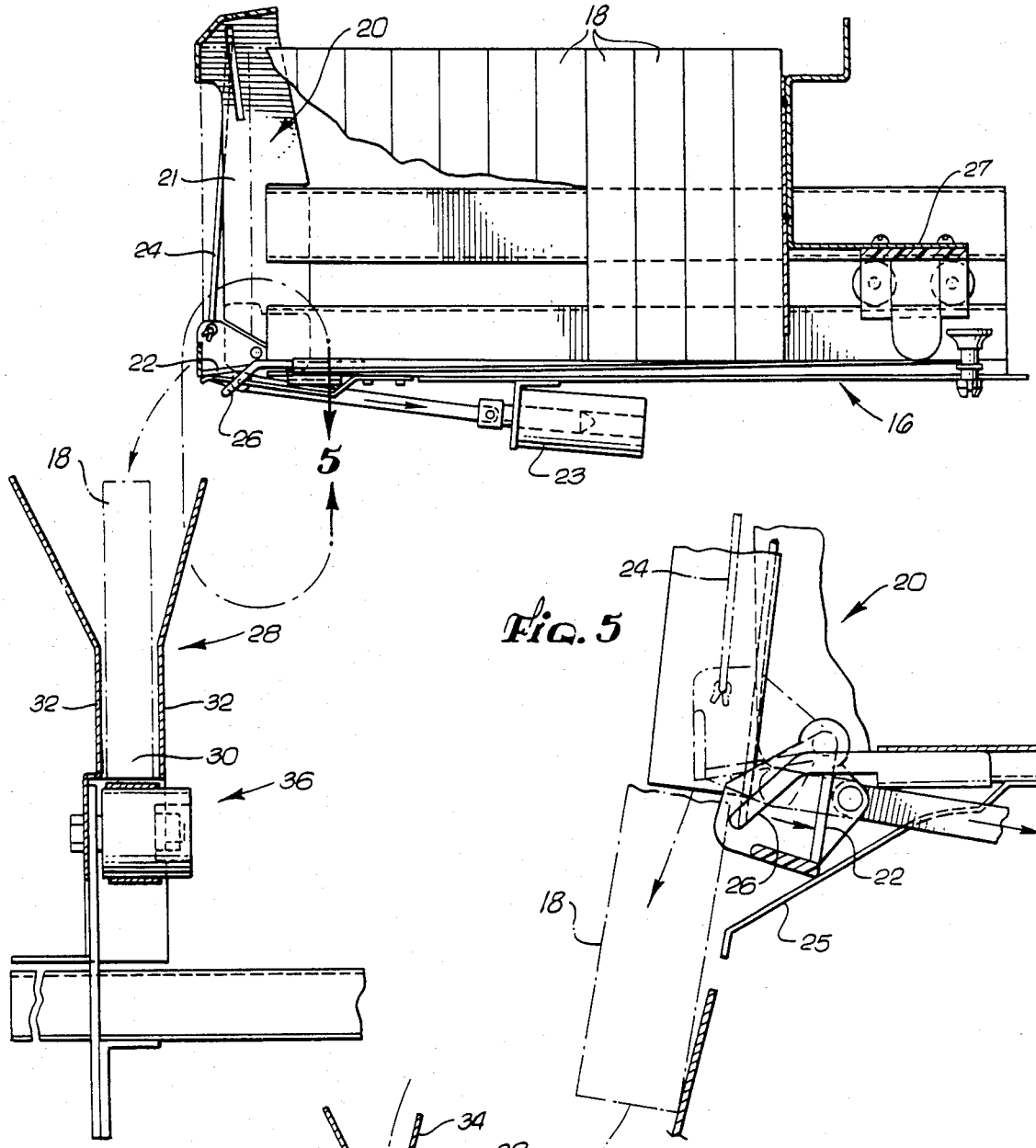
FIG. 4 is a fragmentary cross-sectional view taken from the left inside the machine and showing a receptacle of the bottom row and the conveyor mechanism.
Figure 5:
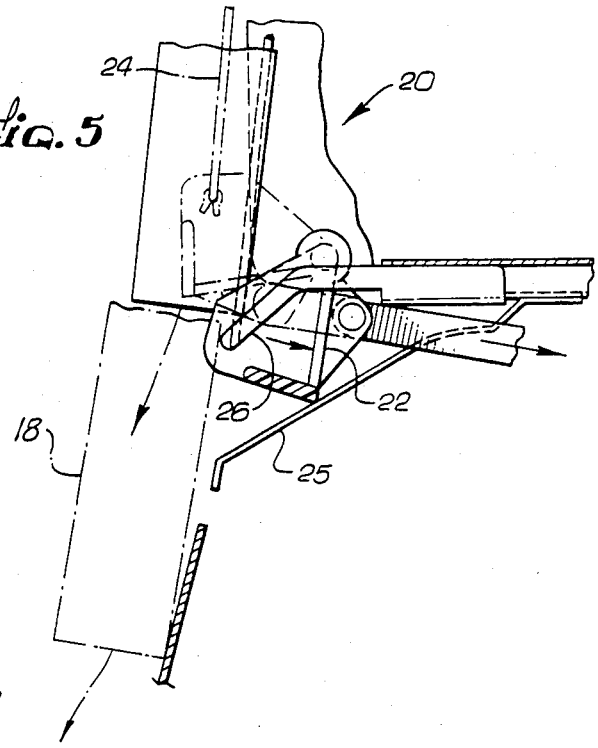
FIG. 5 is an enlarged view of the portion of FIG. 4 indicated by the arrow 5 with the delivery mechanism in an actuated position.

A solenoid 23, that is part of the releasing mechanism 20, is mounted on the drawer 14 beneath the corresponding receptacle 16, as shown in FIG. 4. When actuated, the solenoid 23 causes the door 22 to pivot into an open position while a bail 24 simultaneously presses downwardly on the top of the article 18 pushing it out through the bottom of the releasing mechanism 20 as it compresses a leaf spring 25 and slides across two guide fingers 26. The remaining articles 18 are then moved to the front of the receptacle 16 by a spring driven carriage 27. In this way, each article 18 can be released from the receptacle 16 sequentially.

Figure 3:
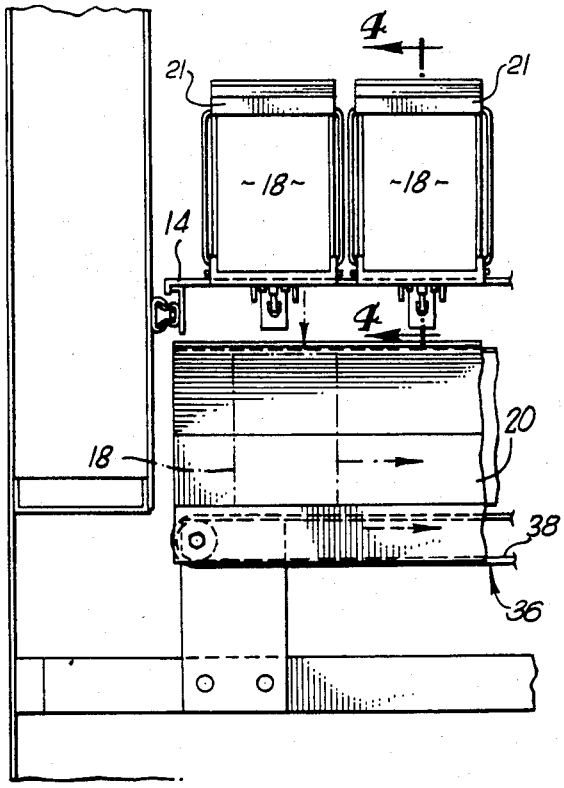
FIG. 3 is a fragmentary front elevation taken inside the machine to show two of the receptacles and the conveyor mechanism.

Extending across the cabinet 12, just behind the front panel 15, forward of the releasing mechanism 20, is an elongated trough-like chamber 28, best shown in FIGS. 3 and 4. Positioned just below the bottom row of receptacles 16, the purpose of the chamber 28 is to receive the articles 18 as they are dispensed by the releasing mechanism 20. The bottom 30 of the chamber 28 is defined by two vertical walls 32 spaced apart just enough to contain one of the articles 18 in the same position in which it would be held in the receptacle 16. The top wall 34 of the chamber 28 fan out toward the front and back of the cabinet 12 to guide the articles 18 into the narrower bottom part 30.

A conveyor mechanism 36, formed by endless belts 38 driven by pulleys 40 and a motor (not shown), extends horizontally across the bottom of the chamber 28 forming the floor of the chamber. The conveyor has two sections 36(*a*) and 36(*b*) that carry the articles 18 toward a delivery mechanism 42 that is centered with respect to the cabinet 12 and positioned between the two conveyor belts 38.

As shown in FIG. 2, the delivery mechanism 42 includes a carrier 44 of U-shaped cross section that, with the delivery mechanism in a closed position as illustrated, forms a center part of the bottom 30 of the chamber 28 where a rectangular portion of the chamber structure is cut away. Forward of the carrier 44 and just below it is an exit tray 46 supported by the front panel 15. Extending upwardly from the tray 46 and integrally formed therewith is a tube 47, the top end of which defines an escape opening 48. Once an article 18 passes through the tube 47 to the exit tray 46 it is readily accessible from outside the cabinet 12 and may be withdrawn.

Figure 6:
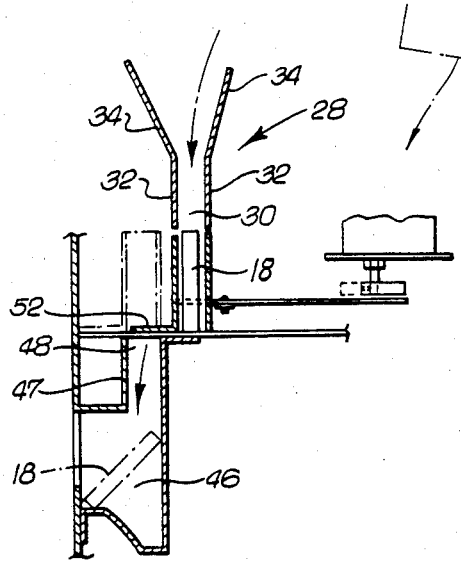
FIG. 6 is an enlarged fragmentary cross-sectional view taken crosswise through the delivery mechanism in the closed position and showing the mechanism in phantom lines in its open position.

When an article 18 within the carrier 44 is to be delivered, the carrier moves forward to an open position (shown in phantom lines in FIGS. 6 and 8) in which the open bottom of the carrier is aligned with an escape opening 48, thus allowing the article to fall into the tray 46. The carrier 44 then returns to its closed position in a reciprocatory manner, its movement being perpendicular to the direction of travel of the conveyor belts 38 and the elongation of the chamber 28.

Extending forward from the front edge of the carrier 44 is a guard plate 52. With the delivery mechanism in its closed position, the guard plate 52 covers the escape opening 48. When the carrier 44 moves forward, the guard plate 52 slides forward beyond the tube 47 and out of the way.

A motor 56 causes movement of the carrier 44 and guard plate 52, the motor being mounted on a shelf 57 beneath the receptacle 16 and directly behind the carrier 44 and, is connected to the carrier by a rigid link 58. The force of the motor 56 is insufficient to cause injury to a hand inserted in the mechanism. A single complete revolution of the motor 56 causes the carrier 44 to move from its closed position to its open position and back to its closed position. The carrier 44 naturally dwells over the exit tray 46 as the link 58 reaches the farthest extent of its travel and the end of the link attached to the motor moves arcuately but primarily cross-wise with respect to the transverse movement of the carrier.

An operating cycle of the machine 10 will now be explained. First a selected releasing mechanism 20 is actuated, causing one of the articles 18 to be ejected forwardly and downwardly into the narrow space between the receptacles 16 and the front panel 15. Simultaneously, the conveyor belts 38 are actuated. The released article 18 falls into the chamber 28 and is guided into the lower chamber portion 36(*a*) where it comes to rest on one of the belts 38. The belt 38 then carries the article 18 transversely toward the center of the machine 10 and loads it into the carrier 44. If the article 18 should initially enter the portion of the chamber 28 directly above the carrier 44, it will, of course, fall directly into the carrier without first coming to rest on either of the belts 38.

Once the released article 18 has entered the carrier 44, its presence will be detected by either or both of two optical article sensors 60, thus actuating the motor 56. The carrier 44 then moves forward and allows the article 18 to fall through the escape opening 48 into the exit tray 46. When the carrier 44 again returns to its closed position, it is sensed by an optical position sensor 62, the signal from the sensor deactivating the motor 56 and providing a positive indication that the article 18 has been dispensed. It should be noted that a signal will not be produced by the position sensor 62 unless two events take place: (1) the article 18 must enter the carrier 44 and (2) the carrier must reciprocate. If an article 18 is not dispensed, due to an empty receptacle 20 or a malfunction of the machine 10, no signal will be produced by the position sensor 62.

The anti-theft characteristics of the machine 10 will now be considered. With the delivery mechanism 42 in its normal closed position there is no access to the interior of the machine 10 through the exit tray 46. By reaching into the exit tray 46, one can at most reach the top of the tube 47 where the escape opening 48 is blocked by the guard plate 52.

If the guard plate 52 were held in an open position and one of the articles 18 were manually released from the receptacle 16 while the carrier 44 was in its open position, there would still be no access to that article from outside the machine 10. Even if the belts were actuated, the article 18 would be deposited behind the carrier 44, which would push the article further back when it returned to its closed position. Moreover, the out-of-sequence operation of the machine 10 would be detectable from the signals produced by the sensors 60 and 62 and the machine could be disabled electronically.

It will be understood from the above description that the machine 10 is an efficient and highly effective dispensing apparatus that has desirable anti-theft characteristics. Nevertheless the machine 10 is simple and requires a minimum vertical dimension between the lowest receptacles 16 and the exit tray 46.

While a particular form of the invention has been illustrated and described, it will be apparent that various modifications can be made without departing from the spirit and scope of the invention.

I claim:

1. A dispensing machine comprising:

a box-like housing having a front panel;

a plurality of receptacles arranged within said housing, each of said receptacles adapted to contain a plurality of articles to be dispensed and having a front end facing said front panel, an open space through which said articles can fall being defined between said receptacles and said front panel;

an article releasing means associated with each of said receptacles and disposed at said front end thereof for releasing said articles sequentially upon actuation thereof;

an elongated article receiving chamber extending horizontally behind said front and beneath said receptacles and positioned so that articles released from said receptacles by said releasing means fall into said chamber;

an exit tray beneath said chamber from which said articles can be removed;

an opening above said exit tray through which said articles can fall into said exit tray, said opening being offset laterally from said chamber;

conveyor means extending along the bottom of said chamber for moving said articles horizontally along said chamber toward that exit tray; and delivery means for moving said articles from said chamber into alignment with said opening whereby said articles are caused to fall into said exit tray, said delivery means including a carrier for said articles and a guard member, and said delivery means having a closed position in which said carrier is aligned to receive articles from said chamber and said guard member covers said opening and an open position in which said carrier is aligned with said opening.

2. The machine of claim 1 wherein:

said delivery means is centrally disposed with respect to said chamber; and said conveyor means is divided into two sections on opposite sides of said delivery means.

3. The machine of claim 1 wherein said carrier and said guard member are movable between said open and closed positions of said delivery means in a direction perpendicular to the elongation of said chamber.

4. The machine of claim 1 wherein:

said delivery means is centrally disposed with respect to said chamber; and said conveyor means comprises at least one endless belt extending horizontally on each side of said delivery means.

5. The machine of claim 1 wherein said opening is offset from said chamber in a direction away from said receptacles.

6. The machine of claim 1 further comprising position sensor means for sensing the position of said delivery means.

7. The machine of claim 1 further comprising article sensor means for sensing the presence of one of said articles in said carrier.

8. The machine of claim 7 further comprising position sensor means for sensing the position of said delivery means.

9. The machine of claim 8 further comprising article sensor means for sensing the presence of one of said articles in said delivery means.

10. A dispensing machine comprising:

a box-like housing having a generally vertical front panel;

a plurality of horizontally oriented elongated receptacles arranged within said housing in horizontal rows and vertical columns, each of said receptacles being adapted to contain a pluality of articles to be dispensed and having a front end facing said front panel, a narrow, open vertical space through which said articles can fall being defined between said receptacles and said front panel;

an article releasing means associated with each of said receptacles and disposed at said front end thereof for releasing said articles sequentially upon actuation thereof;

resilient means for urging said articles along said receptacles toward said releasing means;

an elongated, horizontally oriented article receiving chamber extending horizontally along said front panel beneath said receptacles and positioned so that articles released from said receptacles by said releasing means fall into said chamber;

conveyor means extending along the bottom of said chamber for moving said articles horizontally along said chamber toward the center thereof;

an exit tray beneath said chamber from which said articles can be removed;

an opening above said exit tray through which said articles can fall into said exit tray, said opening being offset laterally from said chamber; and delivery means for moving said articles from said chamber into alignment with said opening whereby said articles are caused to fall into said exit tray, said delivery means including a carrier for said articles, a guard member, and motor means for causing said carrier and guard member to reciprocate between a closed position in which said carrier is aligned to receive articles from said chamber and said guard member covers said opening, and an open position in which said carrier is aligned with said opening.

11. The machine of claim 10 further comprising position sensor means for sensing the position of said delivery means.

12. The machine of claim 10 further comprising article sensor means for sensing the presence of one of said articles in said carrier.

13. A dispensing machine comprising:

a box-like housing having a front panel;

a plurality of receptacles arranged within said housing, each of said receptacles adapted to contain a plurality of articles to be dispensed and having a front end facing said front panel, an open space through which said articles can fall being defined between said receptacles and said front panel;

an article means associated with each of said receptacles and disposed at said front end thereof for releasing said articles sequentially upon actuation thereof;

an elongated article receiving chamber extending horizontally behind said front panel and beneath said receptacles and positioned so that articles released from said receptacles by said releasing means fall into said chamber;

an exit tray beheath said chamber from which said articles can be removed;

an opening above said exit tray through which said articles can fall into said exit tray, said opening being offset laterally from said chamber;

conveyor means extending along the bottom of said chamber for moving said articles horizontally along said chamber toward the exit tray; and delivery means for moving said articles from said chamber into alignment with said opening whereby said articles are caused to fall into said exit tray.

* * * * *